US007322061B2

(12) United States Patent
Carroll

(10) Patent No.: US 7,322,061 B2
(45) Date of Patent: Jan. 29, 2008

(54) MULTIPURPOSE SUPPORT PILLOW

(75) Inventor: Teresa P. Carroll, Athens, AL (US)

(73) Assignee: NuAngel, Inc., Athens, AL (US)

( * ) Notice: Subject to any disclaimer, the term of this patent is extended or adjusted under 35 U.S.C. 154(b) by 0 days.

(21) Appl. No.: 11/369,244

(22) Filed: Mar. 7, 2006

(65) Prior Publication Data

US 2007/0209115 A1 Sep. 13, 2007

(51) Int. Cl.
*A47C 20/00* (2006.01)

(52) U.S. Cl. ..... 5/630; 5/632; 5/652; 5/657; 5/490; 5/640

(58) Field of Classification Search ..... 5/652, 5/657, 636, 640
See application file for complete search history.

(56) References Cited

U.S. PATENT DOCUMENTS

| | | | | | |
|---|---|---|---|---|---|
| 941,043 | A * | 11/1909 | Powell | 5/640 |
| 3,911,512 | A * | 10/1975 | Plate | 5/652 |
| 4,060,863 | A * | 12/1977 | Craig | 5/644 |
| 4,679,262 | A * | 7/1987 | Davis et al. | 5/644 |
| 4,776,049 | A * | 10/1988 | Perron | 5/640 |
| D318,969 | S | 8/1991 | Byrn | |
| 5,148,564 | A * | 9/1992 | Reder | 5/636 |
| 5,261,134 | A | 11/1993 | Matthews | |
| 5,519,906 | A | 5/1996 | Fanto-Chan | |
| 5,546,620 | A | 8/1996 | Matthews | |
| 5,581,833 | A | 12/1996 | Zenoff | |
| 5,661,861 | A | 9/1997 | Matthews | |
| 6,038,720 | A | 3/2000 | Matthews et al. | |
| 6,119,873 | A | 9/2000 | Matthews | |
| 6,230,349 | B1 | 5/2001 | Silver et al. | |
| 6,763,539 | B1 | 7/2004 | Bartley et al. | |
| 6,795,990 | B1 * | 9/2004 | Hutchinson D. C. | 5/632 |
| 6,944,898 | B2 | 9/2005 | Matthews Brown et al. | |
| 2005/0028284 | A1 | 2/2005 | Gartrell et al. | |
| 2005/0066443 | A1 | 3/2005 | Rivera-Wienhold et al. | |
| 2006/0042012 | A1 | 3/2006 | Littlehorn | |

FOREIGN PATENT DOCUMENTS

| | | |
|---|---|---|
| FR | 2379268 | 9/1978 |
| GB | 1508809 | 4/1978 |

* cited by examiner

*Primary Examiner*—Michael Trettel
(74) *Attorney, Agent, or Firm*—Lanier Ford Shaver & Payne P.C.; J. Mark Bledsoe

(57) ABSTRACT

A multipurpose support pillow is provided. The pillow is generally apostrophe-shaped and can be placed and adjusted along any part of the body to provide the desired comfort and support useful for countless applications.

15 Claims, 4 Drawing Sheets

MULTIPURPOSE SUPPORT PILLOW

FIELD OF THE INVENTION

The present invention relates generally to multipurpose support pillows. In particular, the present invention relates to the design of therapeutic support pillows.

BACKGROUND OF THE INVENTION

Most pillow designs concentrate on supporting one specific area of the human body and are rigid in shape, not allowing for the same pillow to be used in a variety of different positions. These devices fail to accommodate people of different sizes and shapes using the same pillow in many diverse positions.

Several pillows have been designed to support an adult's head or a child's head while traveling in a vehicle or while sleeping. Specifically, U.S. Pat. No. 4,679,262 (Davis), U.S. Pat. No. 4,285,081 (Price), U.S. Pat. No. 4,788,728 (Lake), U.S. Pat. No. 4,726,085 (Antonio), and U.S. Pat. No. 2,167,622 (Bentivoglio) all talk about support of the head or neck regions. Those devices fail to support several parts of the body and have limited uses.

A pillow designed for the support of infants and small children while asleep in a sitting position is disclosed in U.S. Pat. No. 4,726,085 (Antonio). It consists of a thin, U-shaped inset of foam rubber covered with fabric. It is placed about the head so that the neck fits into the U-shaped opening and the free ends extend down the chest of the infant, forming a shelf-like configuration about the shoulders. When the infant nods its head downward, forward, or to either side, the shelf of foam rubber supports the head from further movement. This device again, supports only the head, not any other portion of the infant's body.

U.S. Pat. No. 4,731,890 (Roberts) discloses an L-shaped pillow used by nursing mothers. One arm of the pillow is designed to support the baby while the other arm supports the mother's back. Both of the mother's arms are not supported at the same time, therefore the child would have to be put down and the pillow turned over once the mother is ready to change sides. There is no indication that this pillow could be used for any other support purposes. The present invention allows for all of these uses and more in a simple, durable cost-effective manner.

SUMMARY OF THE INVENTION

The present disclosure is directed to a multipurpose support pillow. This is accomplished by providing comma or apostrophe-shaped pillows of various sizes. For most applications, the multipurpose support pillows are in the range of 22-44 inches (width) and 13-26 inches (height), although sizes outside of these ranges may be provide similar functions. The depth of these pillows will depend on the amount of filler material or stuffing.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

The present invention discloses a multipurpose support pillow. The support pillow is curved with one rounded larger end that descends in size and shape as it spirals toward the opposite, smaller rounded end of the pillow. The decreasing size allows for adjustability in the amount of support available to the user. The two ends of the pillow are separated enough so that the user is not confined between the ends of the pillow.

The present invention is light-weight, portable, soft, comfortable, machine washable, hypo-allergenic, and offers multi-functional support to the user. It is also portable, lightweight and convenient for travel. One embodiment of the present invention comprises a zipper-less slip cover and a pillow formed in the shape described above, stuffed with a filler material. An overlap opening on the slip cover allows for simple insertion or removal of the pillow for convenient washing of the slip cover. The present invention may be provided without the slip cover by forming a sheath in the shape described above and stuffing it with a filler material.

The present invention is available in different sizes to meet the different needs of its user, although the apostrophe-like (comma-like) shape of the pillow remains the same. A smaller sized pillow may be used as a travel pillow such as an infant/young child head/neck support pillow, specifically in car seats/infant carriers. A smaller size can also be used for the side, back, or front of the neck for needed support. For entertainment or aesthetic purposes, the pillow can include a sound chip/module for different markets, and the slip cover can be designed to resemble stuffed animals.

A larger support pillow can be used to provide back support, help reduce acid reflux, and may be positioned to offer support to various parts of the body. A larger sized support pillow can also provide support for a nursing mother. The pillow curves to the body and can be flipped from side to side to support mother's arms and nursing infant. The pillow can also be flipped on the same side of mother to accommodate for different nursing positions, such as the cradle or football hold. The larger end of the pillow is designed for support of the infant's head while nursing, helping reduce acid reflux. Back support can also be provided to the infant while being nursed in a side lying position.

Two multipurpose support pillows can be used by a nursing mother on the same side for height elevation. Furthermore, a pillow positioned on each side of a nursing mother can assist in nursing twins. A smaller version of the pillow can be used with a large pillow for height elevation and additional positional support. The smaller pillow can assist some nursing mothers with breast support.

The present invention can also be used in various positions for prenatal support. The curve and decreasing size on one end of the pillow allows for adjustment in individualized abdominal support prior to delivery. The curve and decreasing size on one end of the pillow also allows for adjustment in placement between the knees to help in proper back alignment when in a side-lying position. Adjustable support can also be provided for the back, legs, neck and arms. The pillow can be particularly helpful for abdominal support/protection for cesarean deliveries.

Other uses of the present invention include assisting individuals with muscle weakness or medical conditions as myasthenia gravis, muscular dystrophy, and others. The multipurpose support pillow can be used as a neck support with the pillow curve placed behind the individual's neck, allowing the user's head to rest on the larger side of the pillow. The user can adjust his or her level of comfort by repositioning the pillow to the desired thickness behind the neck, a feature not available on many of the existing pillows. Accordingly, the user is not confined to just one position.

The present invention is also useful for supporting individuals in wheelchairs or in other sitting positions. The pillow can be wrapped around an individual's side for support in an upright position or to use as an arm rest. An additional large pillow can be used for the other side. The pillows provide comfort and support for individuals with conditions as carpal tunnel syndrome and others.

The inner curve of the pillow can be used for orthopedic conditions for elevation and support, while staying securely in position. In a side-lying position, the pillow can be adjusted to provide needed comfort between the knees. A smaller sized pillow can be used to support a single limb, such as under the arm, knee, or ankle. The different sizes of the multipurpose support pillows are also useful for surgery or bedridden patients in positioning and support. For example, the present invention can be used for sitting or hip support to relieve pressure for medical related conditions.

The pillow can be adjusted by the degree of thickness needed for comfort. In a side-lying position, an individual may use the small end of the pillow behind the neck and wrap their arms around the large end. Other individuals may rest their head on the large end and wrap the small end around their neck for support. The pillow can be placed between the arms for comfort, helping the user to expand his or her lung capacity. For individuals sleeping on their backs, the small end of the pillow can be used in the arch of their back or neck. Furthermore, the present invention can also be used to provide support to the arms while driving or performing tasks with computers.

In another embodiment, two pillows can be mechanically coupled together at their smaller ends such that any support offered by one pillow as described above can be used to provide symmetric support to the body area to be supported. The mechanical coupling can be such that the two ends are directly or indirectly in cooperation with one another, and can be achieved through a connection by an elastic strap, by sewing the two ends directly together, or by providing some other link between the two ends. Once constructed, a nursing mother could use this embodiment when seated to support her arms or the baby.

These and other embodiments of the present invention will also become readily apparent to those skilled in the art from the following detailed description of the embodiments having reference to the attached figures, the invention not being limited to any particular embodiment(s) disclosed.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

The various embodiments of the present invention and their advantages are best understood by referring to FIGS. 1 through 4 of the drawings. The elements of the drawings are not necessarily to scale, emphasis instead being placed upon clearly illustrating the principles of the invention. Throughout the drawings, like numerals are used for like and corresponding parts of the various drawings.

Figure 1:
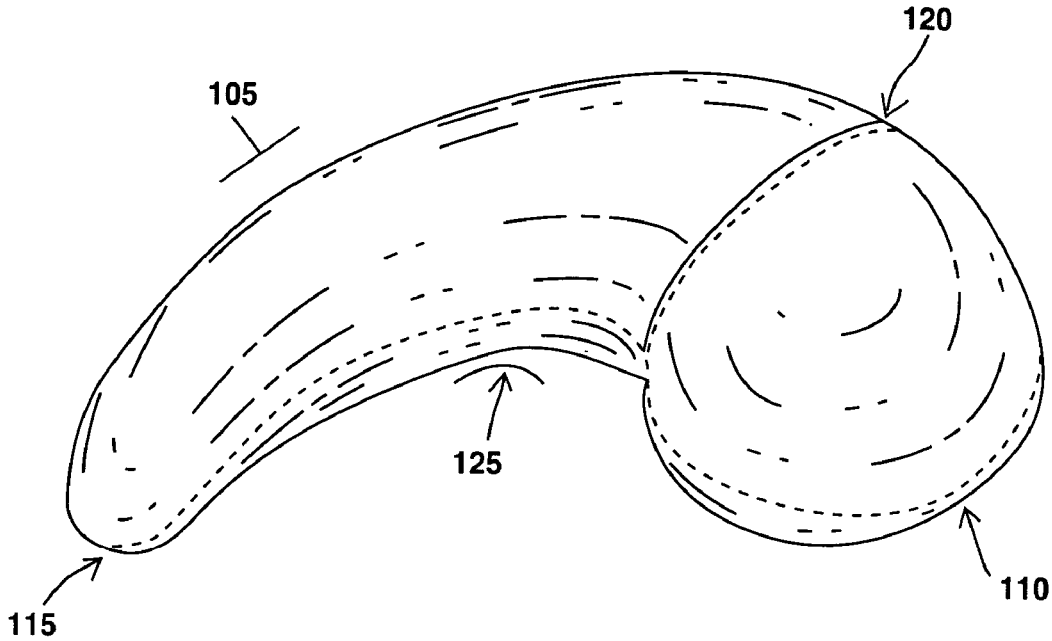
FIG. 1 is a perspective view of the preferred embodiment of the present invention.
Figure 2:
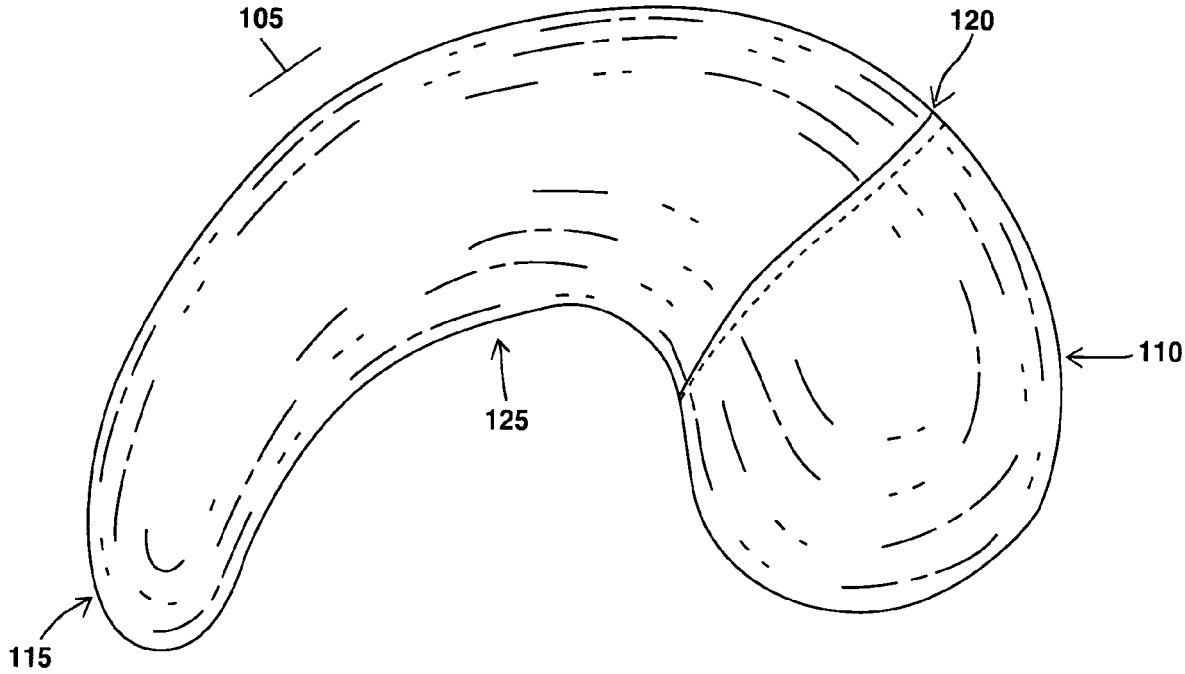
FIG. 2 is a top view of the preferred embodiment of the present invention.
Figure 3:
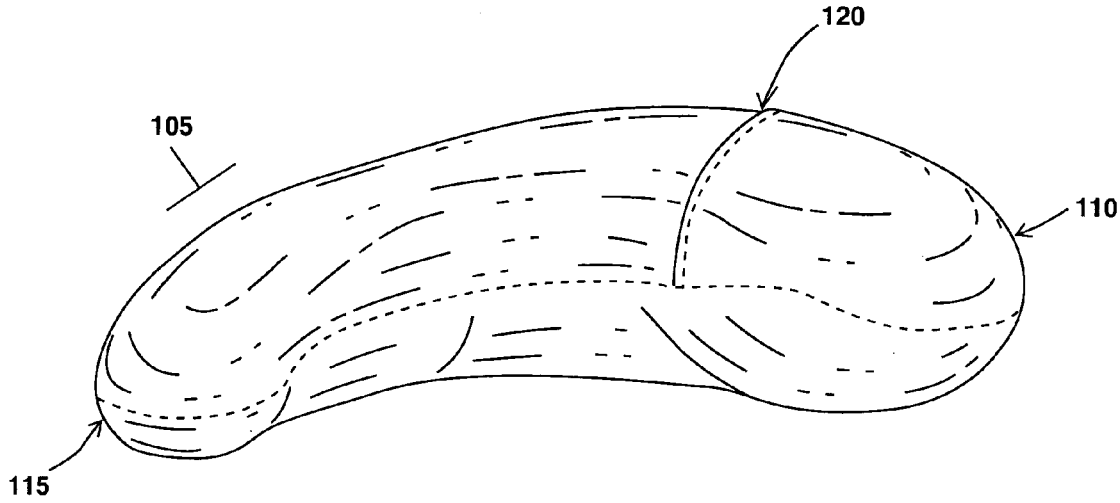
FIG. 3 is a side view of the preferred embodiment of the present invention.

Referring now to FIG. 1, a multipurpose support pillow 105 is shaped like a comma or apostrophe (see FIG. 2) wherein a large, rounded end 110 gradually narrows in size and shape along a conical path as it curves toward the opposite, smaller rounded end of the pillow 115. The pillow is made by stuffing a apostrophe-shaped sheath with a soft, solid, resilient filler. A slip cover may be used for easy cleaning by stitching two pieces of fabric together and adding a third piece to create an overlap 120. Alternatively, the slip cover can be stuffed with stuffed with a filler material, such as airy, down-like clusters that do not clump or bunch. The inner curve of the pillow 125 can be positioned at any point along the user's body to provide the desired support and comfort.

Figure 4:
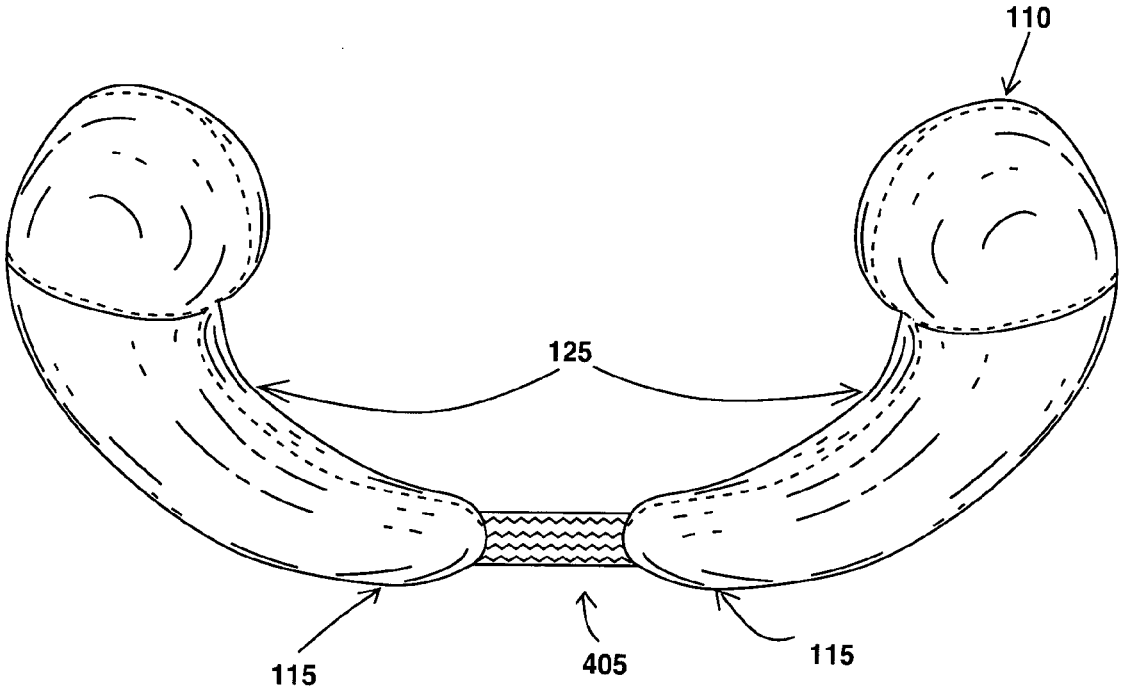
FIG. 4 is a perspective view of an alternative embodiment of the present invention.

Referring now to FIG. 4, in an alternative embodiment of the present invention two multipurpose support pillows can be connected together by an elastic strap 405 at the smaller ends 115 allowing for the larger ends 110 to be used for support. Similarly, the inner curves of the pillow 125 can be placed at any point along the body to provide symmetric support to the desired area.

This invention may be provided in other specific forms and embodiments without departing from the essential characteristics as described herein. The embodiments described above are to be considered in all aspects as illustrative only and not restrictive in any manner. The following claims rather than the foregoing description indicate the scope of the invention.

As described above and shown in the associated drawings, the present invention comprises a multipurpose support pillow. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the present invention.

What is claimed is:

1. A multipurpose support pillow comprising:

a. a first rounded end; and b. a second rounded end connected to said first rounded end via a trunk;

said first rounded end being substantially bulbous-shaped, said bulbous-shaped end connecting to said trunk via a concave neck and larger than said second rounded end, said second rounded end substantially terminating in a rounded point, said pillow tapering toward said second end.

2. The multipurpose support pillow of claim 1 wherein said tapering follows a substantially arcuate path.

3. The multipurpose support pillow of claim 1 wherein said tapering follows a substantially arcuate path resulting in said pillow resembling an apostrophe.

4. A multipurpose support pillow comprising:

a. a first rounded end; and b. a second rounded end;

said first rounded end being substantially bulbous-shaped and larger than said second rounded end, said second rounded end substantially terminating in a rounded point, said pillow tapering toward said second end, wherein the distance between the first end and the second end is from about twenty-two to about forty-four inches.

5. A multipurpose support device comprising a generally apostrophe-shaped slip cover stuffed with a pillow, said pillow comprising a flexible sheath stuffed with a solid, resilient filler material, wherein the apostrophe-shaped slip cover has a first end and a spherical second end connected via a concave neck to a trunk, the spherical second having a radius that is greater than a radius of a cross-section of the trunk.

6. The multipurpose support pillow of claim 5 wherein said filler material is one of the group comprising air-blown polyester fiber, cotton, down, chipped foam.

7. A multipurpose support device comprising a generally apostrophe-shaped slip cover stuffed with a pillow, said pillow comprising a flexible sheath stuffed with a solid, resilient filler material, wherein the distance between the opposite ends of said apostrophe-shaped cover is from about twenty-two to about forty-four inches.

8. A multipurpose support device comprising two generally apostrophe-shaped pillows mechanically coupled to each other at their respective smaller ends, wherein each of said two apostrophe-shaped pillows has a first end and a substantially spherical second end, and the second end is connected via a concave neck to a trunk, the spherical second end having a radius that is greater that a radius of a cross-section of the trunk and the spherical second end protrudes from the trunk.

9. The multipurpose support device of claim 8 wherein said pillows define a cavity.

10. A multipurpose support device comprising two generally apostrophe-shaped pillows mechanically coupled to each other at their respective smaller ends wherein said pillows define a cavity, wherein the distance between the opposite ends of each apostrophe-shaped pillow is from about twenty-two to about forty-four inches.

11. A multipurpose support pillow slip cover comprising:

a. a first rounded end;

b. a second rounded end; and c. a tube that connects said first rounded end to said second rounded end, the tube having a continuous arcuate inner side for interfacing with a user's torso, wherein said first rounded end is substantially bulbous-shaped and larger than said second rounded end, said second rounded end substantially terminating in a rounded point, said slip cover tapering toward said second end, and wherein said bulbous-shaped second rounded end protrudes from said continuous arcuate inner side for fitting around the user's waist.

12. The multipurpose support pillow slip cover of claim 11 wherein said tapering follows a substantially arcuate path.

13. The multipurpose support pillow slip cover of claim 11 wherein said tapering follows a substantially arcuate path resulting in said slip cover resembling an apostrophe.

14. The multipurpose support pillow slip cover of claim 11 further comprising an overlap wherein a pillow may be inserted.

15. A multipurpose support pillow slip cover comprising:

a. a first rounded end; and b. a second rounded end;

said first rounded end being substantially bulbous-shaped and larger than said second rounded end, said second rounded end substantially terminating in a rounded point, said slip cover tapering toward said second end, wherein the distance between the first end and the second end is from about twenty-two to about forty-four inches.

* * * * *